US009803901B2

(12) United States Patent
Pearl, II et al.

(10) Patent No.: US 9,803,901 B2
(45) Date of Patent: Oct. 31, 2017

(54) VAPORIZING REFRIGERANT CHARGING TOOL WITH VISUAL INSPECTION WINDOW

(75) Inventors: David S. Pearl, II, Fort Lauderdale, FL (US); Dragon Bukur, Fort Lauderdale, FL (US); David Foster, Plantation, FL (US); Douglas B. Pearl, Hollywood, FL (US)

(73) Assignee: Uniweld Products, Inc., Fort Lauderdale, FL (US)

( * ) Notice: Subject to any disclaimer, the term of this patent is extended or adjusted under 35 U.S.C. 154(b) by 690 days.

(21) Appl. No.: 13/015,630

(22) Filed: Jan. 28, 2011

(65) Prior Publication Data

US 2012/0023972 A1 Feb. 2, 2012

Related U.S. Application Data

(60) Provisional application No. 61/300,844, filed on Feb. 3, 2010.

(51) Int. Cl.
*F25B 45/00* (2006.01)
*F25B 41/00* (2006.01)

(52) U.S. Cl.
CPC ..... *F25B 45/00* (2013.01); *F25B 41/003* (2013.01); *F25B 2345/00* (2013.01); *F25B 2345/001* (2013.01); *F25B 2345/006* (2013.01)

(58) Field of Classification Search
CPC ..... F25B 45/00; F25B 2345/00; F25B 2345/001; F25B 2345/006
USPC ..... 62/77, 292, 149
See application file for complete search history.

(56) References Cited

U.S. PATENT DOCUMENTS 2,570,322 A * 10/1951 Christopher ..... 137/559
3,916,641 A * 11/1975 Mullins ..... 62/292
4,014,306 A * 3/1977 Ingersoll ..... F02M 29/02 123/590
4,255,646 A * 3/1981 Dragoy et al. ..... 392/396
5,333,467 A * 8/1994 Pearl et al. ..... 62/77
5,390,500 A * 2/1995 White ..... F17C 9/02 165/142
5,852,937 A * 12/1998 Westermeyer et al. ..... 62/125
6,484,526 B2 * 11/2002 Terry ..... 62/292

(Continued)

OTHER PUBLICATIONS

Marghitu, Dan B., Mechanical Engineers Handbook, 2001, Academic Press, Chapter 7, Section 2.6.*

(Continued)

*Primary Examiner* — David Teitelbaum
(74) *Attorney, Agent, or Firm* — Nields, Lemack & Frame, LLC

(57) ABSTRACT

Gas vaporizer for flashing liquid to vapor received from a source prior to introduction into a compressor or the like, such as in air conditioning or refrigeration systems. In certain embodiments the vaporize includes an adapter member for connection to a liquid source, a connector member having a plurality of flow passages for facilitating the transfer of heat to fluid present therein to vaporize the same, a body portion providing visual access such as via one or more sight glasses to an internal chamber therein for visual confirmation that liquid has been vaporized, and a hose connecting member for connection to a point of destination such as a compressor. In certain embodiments, the connector has an axial bore containing a high thermal conductive material.

11 Claims, 8 Drawing Sheets

(56) References Cited

U.S. PATENT DOCUMENTS

| | | | | |
|---|---|---|---|---|
| 2002/0170308 | A1* | 11/2002 | Rakowski et al. | 62/292 |
| 2006/0107680 | A1 | 5/2006 | Overbeck | |
| 2017/0122632 | A1 | 5/2017 | Pearl et al. | |

OTHER PUBLICATIONS

GCC communication dated Sep. 6, 2016 in corresponding GCC patent application No. GC 2011-17710.

* cited by examiner

FIG. 3
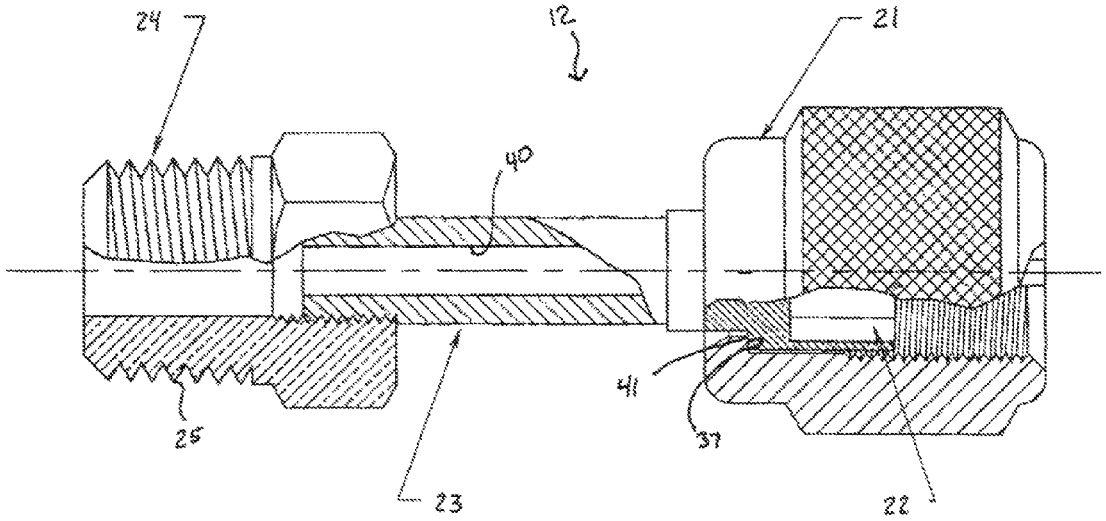
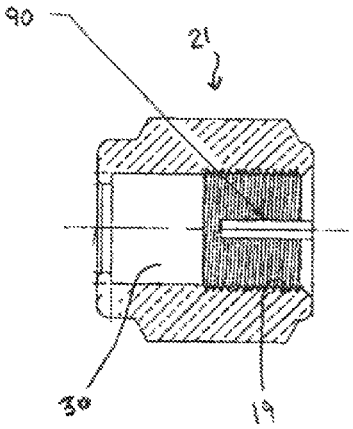
FIG. 7
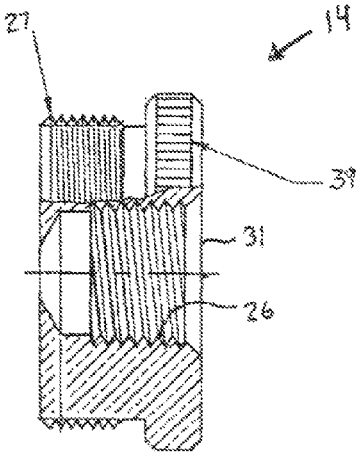
FIG. 6

FIG. 4
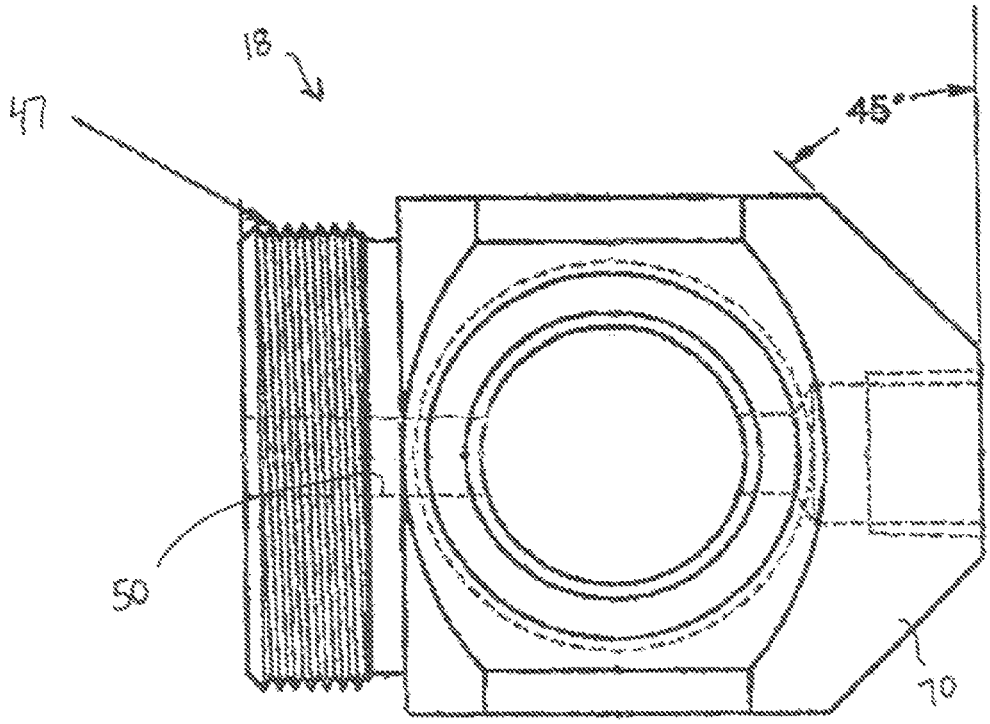
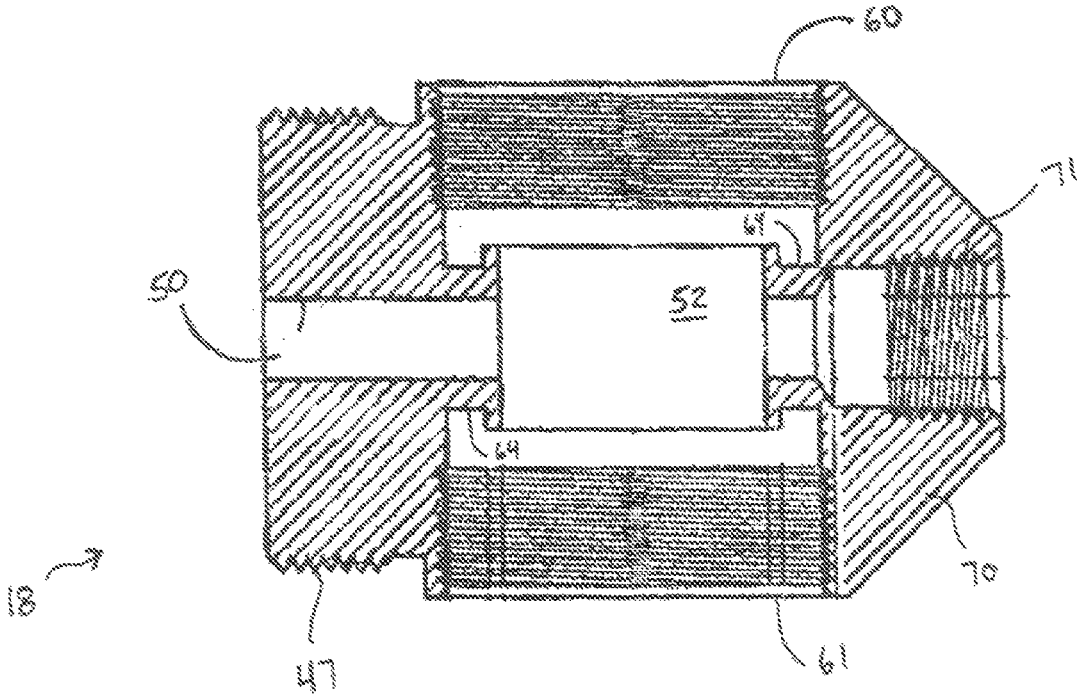
FIG. 4A

10'

16'
50'
42
20
14
21
52'
84
67
65
63
89
43'
23
22
19

VAPORIZING REFRIGERANT CHARGING TOOL WITH VISUAL INSPECTION WINDOW

This application claims priority of U.S. Provisional Application Ser. No. 61/300,844 filed Feb. 3, 2010, the disclosure of which is hereby incorporated by reference.

BACKGROUND

Mechanical Air Conditioning and Refrigeration is accomplished by continuously circulating, evaporating, and condensing a fixed supply of refrigerant in a closed system. Charging or recharging an Air Conditioning or Refrigeration system with refrigerant is done through the low side suction intake fitting with the use of manifold gauges and service hoses. There are several types of refrigerants used and some can be charged as a vapor and others must be charged as a liquid.

For example, R-410A is replacing R-22 refrigerant. R-410A is a mixture of HFC-32 and HFC-125, and is thus considered to be zeotropic. Zeotropic refrigerants such as R-410A must be charged as a liquid from a canister due to the possibility of fractionation of the blend of refrigerants it contains. The range of temperatures at which components in the blended components of R-410A refrigerant boil (temperature glide) is <0.3° F., making it a near-azeotropic refrigerant mixture.

Since the two components of zeotropic refrigerants such as R-410A have different boiling points, the components fractionate during boiling. That is, as the temperature increases, the lower boiling point components vaporize first. The vapor thus has a higher concentration of the lower boiling components than the liquid, and a lower concentration of the higher boiling components. When such a fluid blend is stored in a closed container in which there is a vapor space above the liquid, the composition of the vapor is different from the composition of the liquid. If the fluid is then removed from the container to charge an air conditioning system, for example, fractionation can take place, with accompanying changes in composition. Such changes can cause a refrigerant to have a composition outside of specified limits, to have different performance properties or even to become hazardous, such as by becoming flammable.

R-410A must be liquid charged into the low side of the system, so the components in the blend do not separate. Charging by weight is the preferred method of admitting the liquid charge. To accomplish this, most R-410A refrigerant cylinders must be inverted, or turned up-side-down, to allow liquid refrigerant to flow freely from the cylinder. A charging manifold valve and services hoses are used to connect the refrigerant cylinder to the system. However, assurance that no liquid is entering the system is essential for proper charging and to avoid damaging the compressor.

SUMMARY

The shortcomings of the prior art have been overcome by the present disclosure, which relates to a gas vaporizer and method for flashing liquid to vapor received from a source prior to introduction into a compressor or the like, such as in air conditioning or refrigeration systems. In certain embodiments, refrigerant is removed from a source, such as a pressurized cylinder, as a liquid, and is vaporized by the gas vaporizer. The vapor is then introduced into an air conditioning or refrigeration system, such as the compressor or the like. In certain embodiments, the vaporize includes an adapter member for connection to a liquid source, a connector member for facilitating the transfer of heat to fluid present therein to vaporize the same, a body portion providing visual access such as via one or more sight glasses to an internal chamber therein for visual confirmation that liquid has been vaporized, and a hose connecting member for connection to a point of destination such as a compressor. The vaporization of the liquid can be monitored via the sight glass, and can be metered by controlling the flow rate of liquid through the device, such as with the charging manifold valve. Oppositely positioned sight glasses allows for ambient light to enter one side and render the fluid in the chamber visible through the other side.

In certain embodiments, the connector member has a plurality of flow passages that facilitate the transfer of heat to the fluid present in the flow passages. In certain embodiments, the connector member includes a high thermal conductive material such as sintered metal to facilitate the transfer of heat to the fluid present in the connector member.

BRIEF DESCRIPTION OF THE DRAWINGS

FIG. 3 is a cross-sectional view of an inlet adapter in accordance with certain embodiments;

FIG. 4 is a front view of a vaporizer body in accordance with certain embodiments;

FIG. 4A is a cross-sectional view of the vaporizer body of FIG. 4 in accordance with certain embodiments;

FIG. 6 is a cross-sectional view of a cap in accordance with certain embodiments;

FIG. 7 is a cross-sectional view of a hose nut in accordance with certain embodiments;

DETAILED DESCRIPTION

Figure 1:
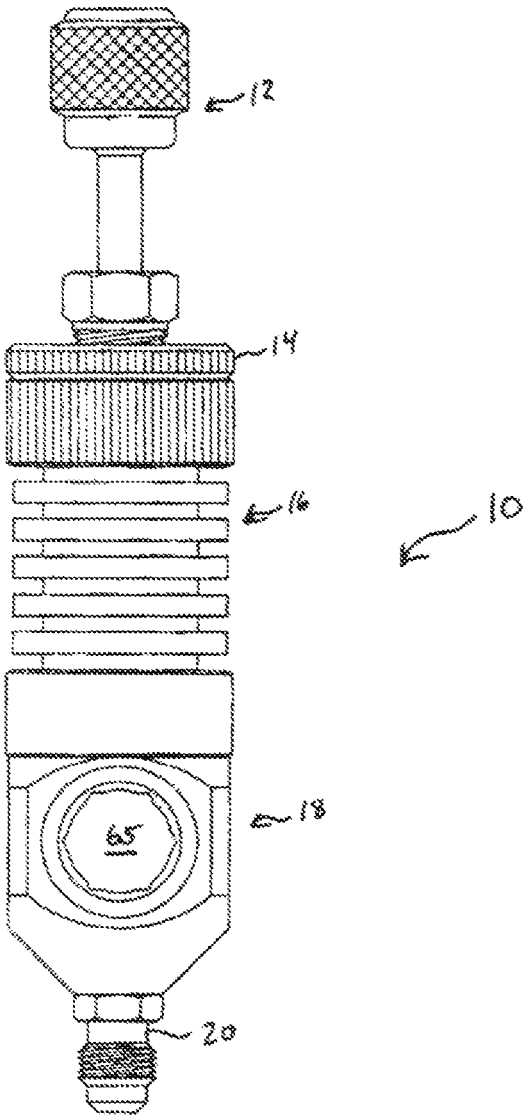
FIG. 1 is a front view of a vaporizer in accordance with certain embodiments.
Figure 2:
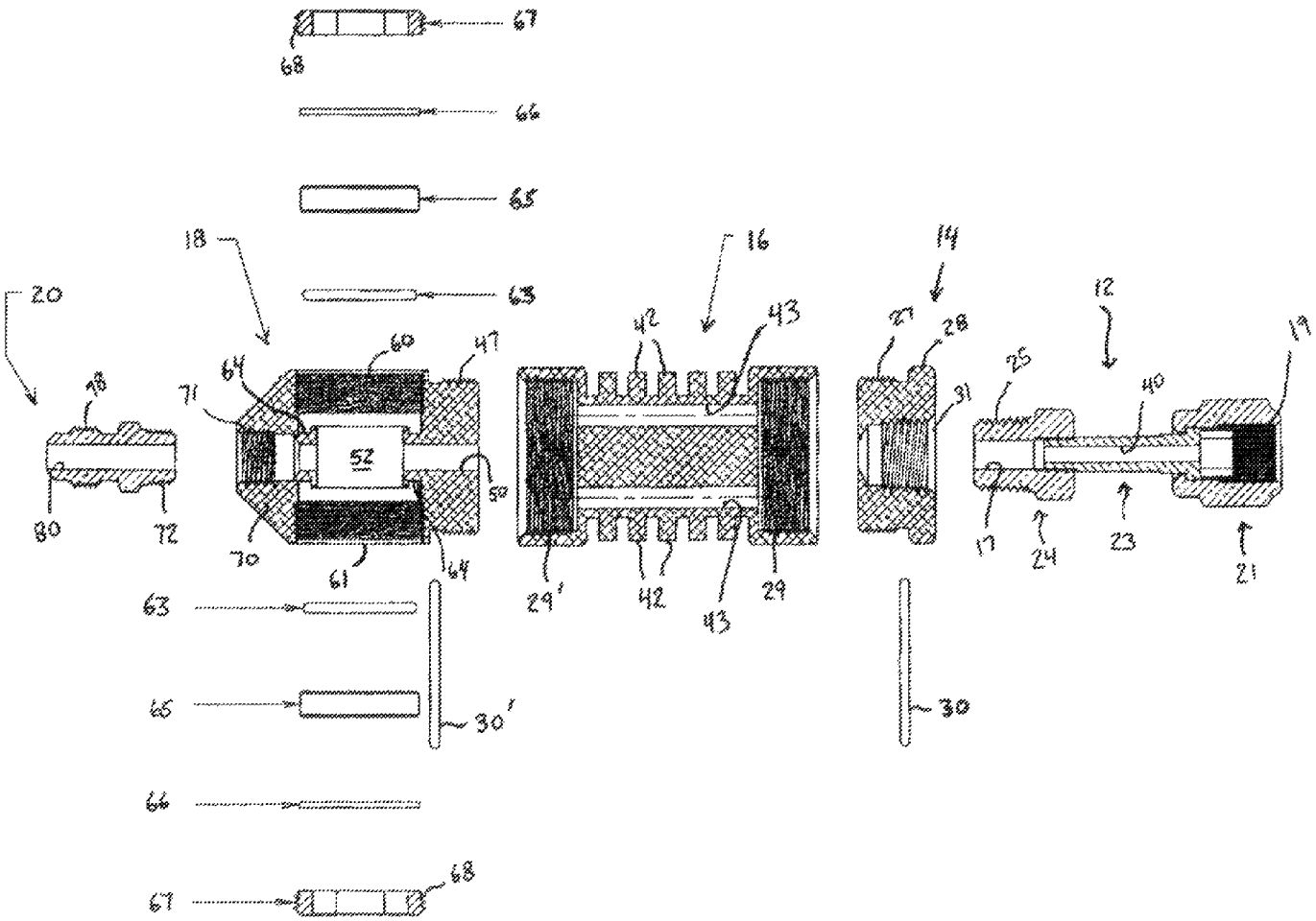
FIG. 2 is an exploded, cross-sectional view of a vaporizer in accordance with certain embodiments.

Turning first to FIGS. 1 and 2, there is shown a gas vaporizer 10 in accordance with certain embodiments. In the embodiment shown, the vaporizer 10 includes an inlet adapted assembly 12, a cap 14, a connector 16, a main body 18, and a hose connector 20.

As best seen in FIG. 3, the inlet adapter assembly 12 includes a hose nut 21 that mates to one end of inlet nipple 23. Preferably a neoprene sleeve 22 or the like is interposed between the nipple 23 and the hose nut 21 and serves as a gasket to help effectuate a seal. The opposite end of inlet nipple 23 is threadingly coupled to inlet nut 24 as shown. The hose nut 21, as seen in FIG. 7, includes an internal cavity 81 that is configured to receive in a lower portion thereof the inlet nipple 23. The upper portion of the cavity 81 is internally threaded with threads 19 to mate to a fluid source such as a refrigerant charging manifold (not shown). Preferably the nut 21 includes one or more (preferably two, spaced 180° apart) axially extending vent slots 90. The vent slots 90 allow vapor to vent in the direction of the charging manifold upon disconnection of the device from the manifold.

Figure 8:
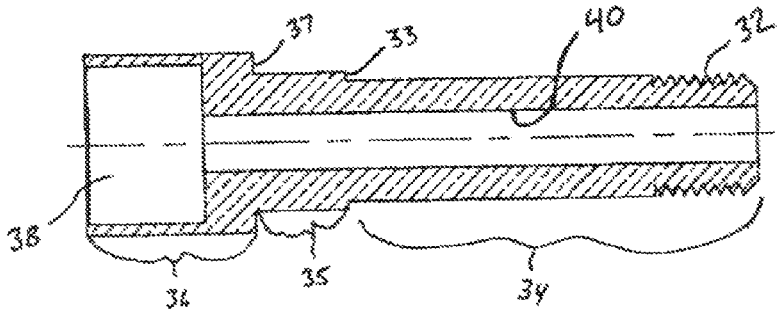
FIG. 8 is a cross-sectional view of an inlet nipple in accordance with certain embodiments.

FIG. 8 shows inlet nipple 23, one end of which has external threads 32 for mating with internal threads in inlet nut 24 (FIG. 3). The inlet nipple 23 is stepped, and thus includes a first elongated portion 34 having a first diameter, a second portion 35 defined at shoulder 33 having a second diameter larger than said first diameter, and a third portion 36 defined at shoulder 37 having a third diameter larger than the second diameter. The third portion 36 includes a cavity 38 that is preferably lined with a neoprene sleeve 22 (FIG. 3). Third portion 36 is configured to fit into hose nut 21, with shoulder 37 seating against a corresponding shoulder 41 in the hose nut 21 (FIG. 3). An axial bore 40 communicates with cavity 38 and axial bore 17 in inlet nut 24 and extends through the inlet nipple 23 as shown. Alternatively, inlet nut 24 can be eliminated and the inlet nipple 23 can be threaded directly into cap 14.

Inlet nut 24 also includes external threads 25 for threading engagement with corresponding internal threads 26 in bore 31 of cap 14. Preferably the cap 14 (FIG. 6) includes an upper annular portion 28 that has a knurled surface 39 to facilitate grasping and turning of the cap 14 by the fingers of a user. Cap 14 includes external threads 27 that mate with corresponding internal threads 29 of connector 16. An O-ring (FIG. 2) can be positioned just below the annular portion to help seal the connection between the cap 14 and the connector 16.

Figure 5:
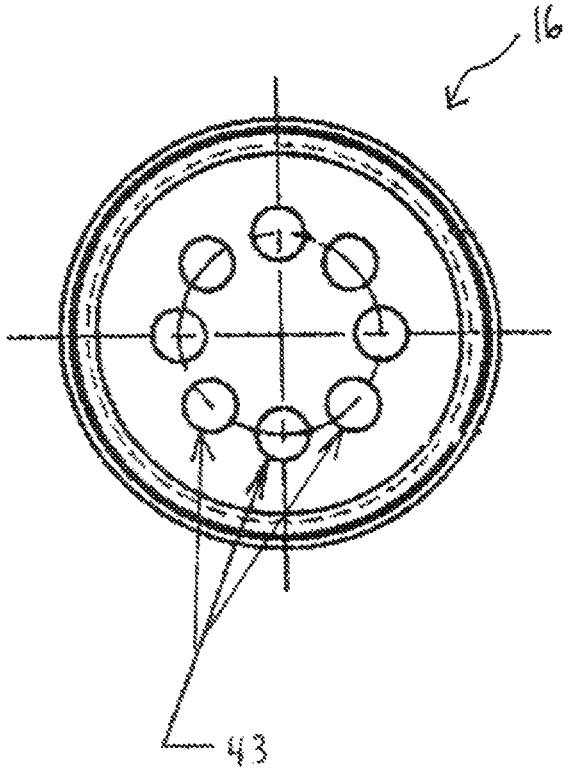
FIG. 5 is a top view of a connector in accordance with certain embodiments.

Connector 16 is preferably made of a heat conductive material, such as aluminum, in order to aid in the transfer of thermal energy to the liquid refrigerant. Connector 16 is generally cylindrical and has a first end with internal threads 29, a main body with a plurality of axial bores 43, and a second end with internal threads 29'. The connector 16 also includes a plurality of spaced, annular fins 42 extending radially outwardly from the main body of the connector 16. In the embodiment shown, there are five such fins 42, although those skilled in the art will appreciate that more (e.g., eight) or fewer fins can be used. The fins 42 serve to optimize the heat transfer from the ambient to the refrigerant in the internal bores 43 of the connector 16. As best see in FIG. 5, the plurality of spaced axially extending bores 43 are preferably arranged in a circular pattern and extend the length of the connector 16. The bores 43 are arranged to receive, via inlet adapter assembly 12, liquid refrigerant. As the liquid refrigerant travels through the bores 43, heat is transferred from ambient and vaporizes the refrigerant.

Connector 16 mates with body 18 via internal threads 29' which correspond to external threads 47 on one end of the body 18. An O-ring 30' can be used to seal the connection. Preferably body 18 is also made of a heat conductive material, such as aluminum. A centrally located axial bore 50 extends through the body 18. When the body is assembled to the connector 16, the bore 50 is in fluid communication with each of the bores 43 in connector 16, thus any fluid in the bores 43 combines into a single stream in bore 50. Axial bore 50 communicates with a generally centrally located chamber 52 in body 18. Chamber 52 has a diameter larger than the diameter of bore 50. Preferably the chamber 52 is symmetrically positioned in body 18 such that the axial centerline of the bore 50 aligns with the axial centerline of the chamber 52.

The body 18 includes radial apertures 60, 61 that provide a vapor window that allows visual access to the chamber 52. As seen in FIG. 2, each aperture 60, 61 accommodates a preferably disk-shaped sight glass 65, sealed in a respective aperture by an O-ring 63 or the like that seats in a respective annular groove 64 formed in the body 18. Each sight glass 65 is preferably made of glass or other transparent material suitable for the application, and is secured in its aperture by a slip ring 66 and screw 67, the screw 67 having external threads 68 that mate with corresponding internal threads formed in each aperture 60, 61. Through the thus formed window, the status of vaporization of the liquid in the device 10 can be visually monitored, and can be controlled by increasing or decreasing the residence time of the liquid in the device.

Figure 9:
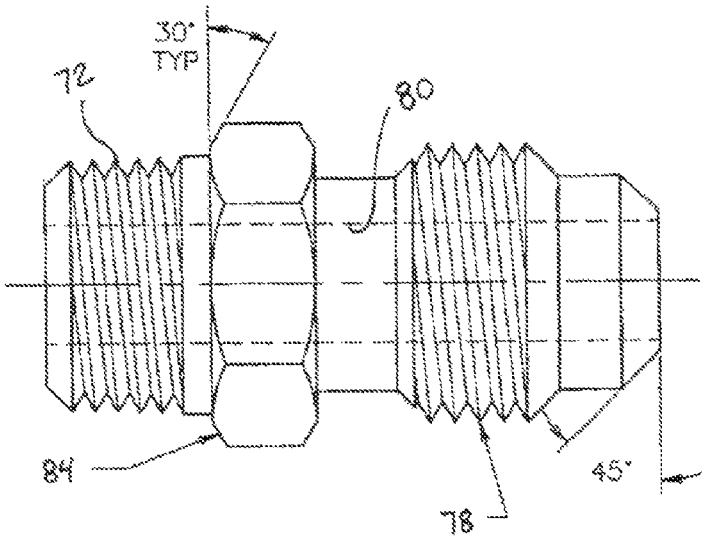
FIG. 9 is a side view of a hose connector in accordance with certain embodiments.

Bore 50 expands radially outwardly in tapered end 70 of the body 18 and includes internal threads 71 that mate with external threads 72 on hose connector 20. The hose connector 20 includes a preferably centrally located axial bore 80 shown in FIG. 2 and in phantom in FIG. 9. When the connector 20 is assembled to the body 18, the axial bore 80 is in fluid communication with axial bore 50 (and thus chamber 52). The connector 20 includes a radially extending hexagonal member 84 to facilitate attachment of the connector to the body 18, and attachment of a hose (not shown) to the connector, such as by hand or with a wrench.

In operation, the hose nut 21 is connected to a refrigerant charging manifold, for example, via internal threads 19 in the nut 21. The hose connector at the opposite end of the device 10 is coupled to a service hose that is in fluid communication with the low side of an air conditioning or refrigeration unit, for example, via external threads 78 on the hose connector 20. Liquid refrigerant is then introduced into the device 10, by opening the valve on the charging manifold. As the liquid refrigerant flows through the device and enters the plurality of axial bores 43 in the connector 16, the liquid begins to vaporize as a result of heat transfer from the ambient optimized with the annular fins 42. Since it is desirable, if not imperative, that all of the liquid vaporize before it reaches the air conditioning or refrigeration unit, the status of the vaporization can be monitored visually via the visual window provided in the body 18. If excessive liquid is present in the chamber 52, where the liquid and vapor in the flow passages 43 have merged, the flow rate of liquid entering the device 10 can be slowed using the charging manifold valve in order to increase the residence time of the liquid in the device 10, and particularly in the connector 16 where most of the vaporization occurs. Similarly, if no liquid is present in the chamber 52, the flow rate of liquid entering the device 10 can be increased, until the optimal flow rate is achieved.

Figure 10:
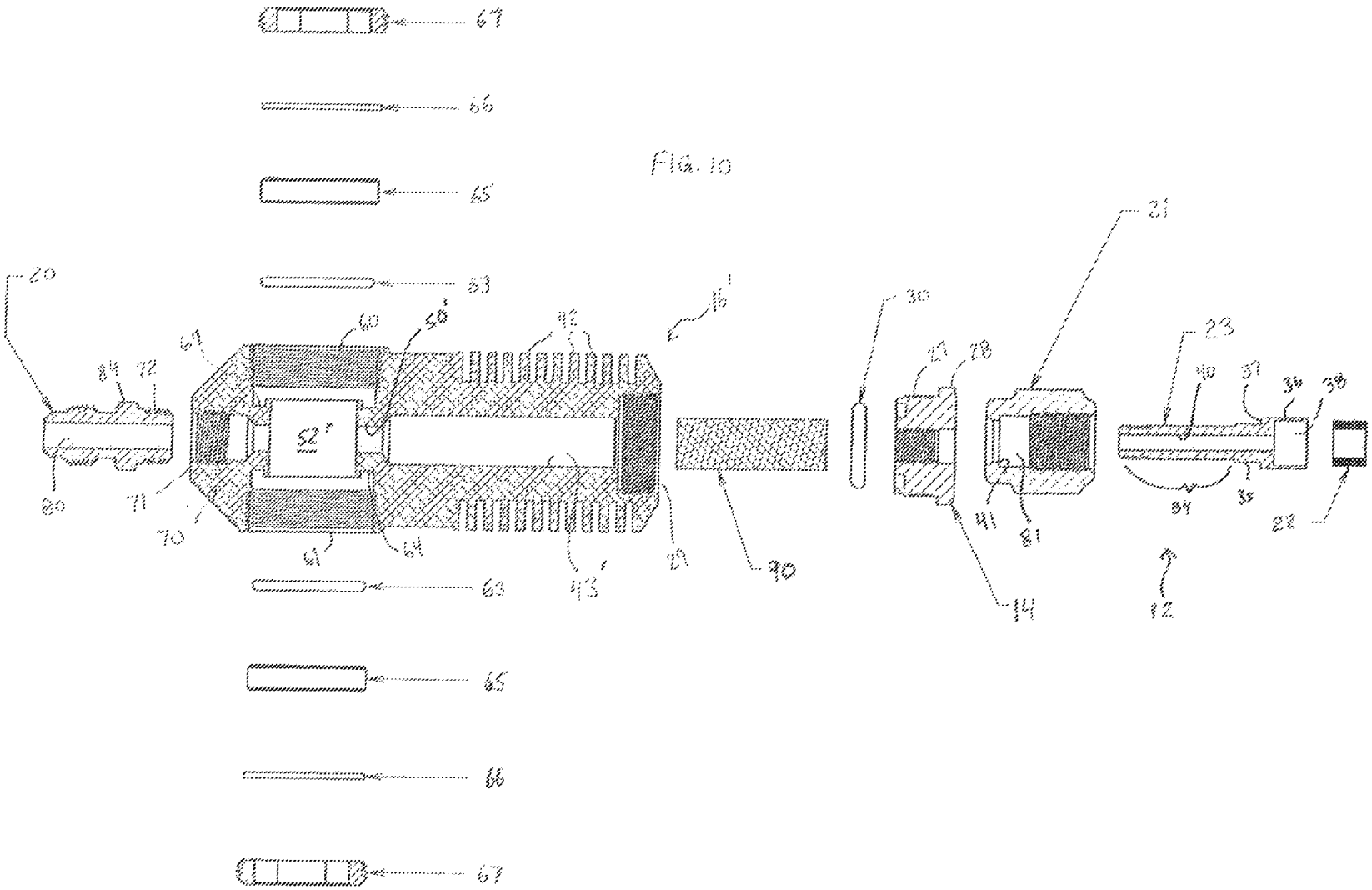
FIG. 10 is an exploded view of a vaporizer in accordance with an alternative embodiment.
Figure 11:
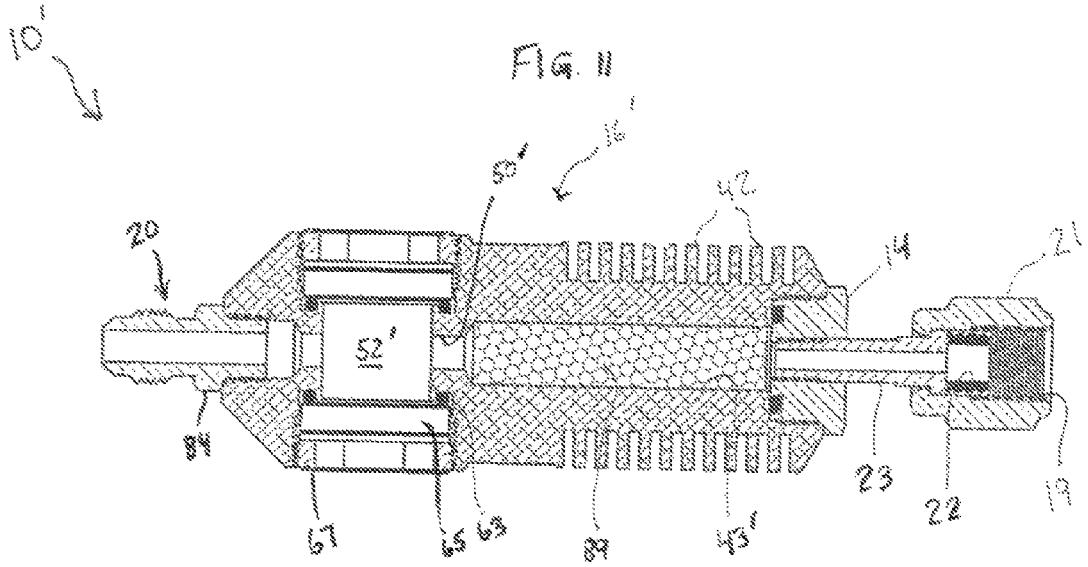
FIG. 11 is a cross-sectional view of the vaporizer of FIG. 10 in an assembled condition.

Turning now to FIGS. 10 and 11, where like reference numerals designate similar parts in previous figures, the connector 16' includes an internal axial bore 43', which is preferably centrally located within the body of the connector 16'. The internal axial bore 43' is configured to receive a high thermal conductive material 89 capable of transferring energy to fluid in the connector. Suitable high thermal conductive materials include sintered copper, sintered brass, sintered bronze, and the like, with sintered copper being particular preferred. The high thermal conductive material can be in the form of a sintered metal filter 90, which is typically manufactured by selecting metal powder of specific particle size distribution, molding them into the required shape and high temperature sintering in hydrogen to obtain a strong porous structure. Particle sizes ranging from about 50 to about 500 microns, preferably 150-350 microns, most preferably about 250 microns, can be used. Preferably the high thermal conductive material 89 occupies the volume of the bore 43'. In certain embodiments, the high thermal conductive material is a sintered metal filter about one inch in length and ⅜ inches in diameter.

As is the case with the embodiments of FIGS. 1-9, the inlet adapter assembly 12 includes a hose nut 21 that mates to one end of inlet nipple 23. Preferably a neoprene sleeve 22 or the like is interposed between the nipple 23 and the hose nut 21 and serves as a gasket to help effectuate a seal. The opposite end of inlet nipple 23 is threadingly coupled to cap 14 as shown. The hose nut 21 includes an internal cavity 81 that is configured to receive in a lower portion thereof the inlet nipple 23. The upper portion of the cavity 81 is internally threaded with threads 19 to mate to a fluid source such as a refrigerant charging manifold (not shown). Preferably the nut 21 includes one or more (preferably two, spaced 180° apart) axially extending vent slots 90. The vent slots 90 allow vapor to vent in the direction of the charging manifold upon disconnection of the device from the manifold.

The inlet nipple 23 is stepped, and thus includes a first elongated portion 34 having a first diameter, a second portion 35 defined at shoulder 33 having a second diameter larger than said first diameter, and a third portion 36 defined at shoulder 37 having a third diameter larger than the second diameter. The third portion 36 includes a cavity 38 that is preferably lined with neoprene sleeve 22. Third portion 36 is configured to fit into hose nut 21, with shoulder 37 seating against a corresponding shoulder 41 in the hose nut 21. An axial bore 40 communicates with cavity 38 and axial bore 17' in cap 14, and extends through the inlet nipple 23 as shown. Preferably the cap 14 includes an upper annular portion 28 that has a knurled surface to facilitate grasping and turning of the cap 14 by the fingers of a user. Cap 14 includes external threads 27 that mate with corresponding internal threads 29 of connector 16'. An O-ring 30 can be positioned just below the annular portion 28 to help seal the connection between the cap 14 and the connector 16'.

Connector 16' is preferably made of a heat conductive material, such as aluminum, in order to aid in the transfer of thermal energy to the liquid refrigerant. Connector 16' is generally cylindrical and has a first end with internal threads 29, a main body with axial bore 43', and a second end. The connector 16' also includes a plurality of spaced, annular fins 42 extending radially outwardly from the main body of the connector 16'. In the embodiment shown, there are ten such fins 42, although those skilled in the art will appreciate that more or fewer fins can be used. The fins 42 serve to optimize the heat transfer from the ambient to the refrigerant in the internal bore 43' of the connector 16'.

The axially extending bore 43' is arranged to receive, via inlet adapter assembly 12, liquid refrigerant. As the liquid refrigerant travels through the high thermal conductive material contained in the bore 43', heat is transferred from ambient and vaporizes the refrigerant. Those skilled in the art will appreciate that although a single bore 43' is shown, a plurality of spaced bores 43', each containing a high thermal conductive material, can be used. If a plurality of axial bores are used, the connector 16' can be manufactured in two separate parts, as described with respect to the embodiments of FIGS. 1-9 where body 18 is a separate part from connector 16, in view of the manufacturing steps necessary to have a plurality of the axial bores conjoin in the region where they communicate with the bore 50. Alternatively still, where a plurality of bores is used, some can be devoid of high thermal conductive material (as in the embodiments of FIGS. 1-9).

Connector 16' includes a preferably centrally located axial bore 50' in fluid communication with the bore or bores 43'. The axial bore 50' is positioned downstream, in the direction of fluid flow, of the bore 43', and communicates with a generally centrally located chamber 52'. Chamber 52' has a diameter larger than the diameter of bore 50'. Preferably the chamber 52' is symmetrically positioned in the connector 16' such that the axial centerline of the bore 50' aligns with the axial centerline of the chamber 52'.

Radial apertures 60, 61 in connector 16' provide a vapor window that allows visual access to the chamber 52'. Each aperture 60, 61 accommodates a preferably disk-shaped sight glass 65, sealed in a respective aperture by an O-ring 63 or the like that seats in a respective annular groove 64 formed in the connector 16'. Each sight glass 65 is preferably made of glass or other transparent material suitable for the application, and is secured in its aperture by a slip ring 66 and screw 67, the screw 67 having external threads 68 that mate with corresponding internal threads formed in each aperture 60, 61. Through the thus formed window, the status of vaporization of the liquid in the device 10' can be visually monitored, and can be controlled by increasing or decreasing the residence time of the liquid in the device.

Bore 50' expands radially outwardly in tapered end 70 of the connector 16' (and downstream, in the direction of fluid flow, of the chamber 52') and includes internal threads 71 that mate with external threads 72 on hose connector 20. The hose connector 20 includes a preferably centrally located axial bore 80. When the hose connector 20 is assembled to the connector 16', the axial bore 80 is in fluid communication with axial bore 50'. The hose connector 20 includes a radially extending hexagonal member 84 to facilitate attachment of the hose connector to the connector 16', and attachment of a hose (not shown) to the connector, such as by hand or with a wrench.

In operation, the hose nut 21 is connected to a refrigerant charging manifold, for example, via internal threads 19 in the nut 21. The hose connector at the opposite end of the device 10 is coupled to a service hose that is in fluid communication with the low side of an air conditioning or refrigeration unit, for example, via external threads 78 on the hose connector 20. Liquid refrigerant is then introduced into the device 10', by opening the valve on the charging manifold. As the liquid refrigerant flows through the device and enters the axial bore 43' containing a high thermal conductive material 89 in the connector 16', the liquid begins to vaporize as a result of heat transfer from the ambient optimized with the annular fins 42. Since it is desirable, if not imperative, that all of the liquid vaporize before it reaches the air conditioning or refrigeration unit, the status of the vaporization can be monitored visually via the visual window provided in the connector 16'. If excessive liquid is present in the chamber 52', where the liquid and vapor in the bore 43' have merged, the flow rate of liquid entering the device 10' can be slowed using the charging manifold valve in order to increase the residence time of the liquid in the device 10', and particularly in the connector 16' where most of the vaporization occurs. Similarly, if no liquid is present in the chamber 52', the flow rate of liquid entering the device 10' can be increased, until the optimal flow rate is achieved.

What is claimed is:

1. A vaporizer, comprising:

an adapter member for connection to a liquid source, said adapter member comprising a hose nut having one or more axially extending vent slots;

a connector member in fluid communication with said adapter member and having a plurality of internal flow passages and a plurality of spaced, annular fins extending radially outwardly from a main body of said connector member and exposed to the ambient for transferring heat from the ambient to liquid present in said internal flow passages to vaporize said liquid in said plurality of internal flow passages;

a body portion coupled to said connector member, said body portion having a single internal chamber in fluid communication with each of said plurality of internal flow passages, and at least one window providing visual access to said internal chamber; and a hose connector in fluid communication with said body portion;

wherein, when said vaporizer in use is connected to said liquid source via said hose nut, said plurality of internal flow passages contains the vaporized liquid.

2. The vaporizer of claim 1, wherein said body portion includes two windows providing visual access to said internal chamber.

3. The vaporizer of claim 2, wherein said two windows are positioned opposite each other in said body portion.

4. The vaporizer of claim 1, wherein said at least one window is provided in an aperture in said body portion.

5. The vaporizer of claim 1, wherein the connector member is composed of a heat conductive material.

6. The vaporizer of claim 5, wherein the heat conductive material is aluminum.

7. The vaporizer of claim 1, further comprising an inlet nipple to which said hose nut mates, said inlet nipple being in fluid communication with said connector member.

8. The vaporizer of claim 7, further comprising a cap, said cap being interposed between said inlet nipple and said connector member.

9. A vaporizer, comprising:

an inlet member for connection to a liquid source, said inlet member comprising a hose nut having one or more axial vent slots;

a cylindrical connector member having a plurality of axial bores in fluid communication with said inlet member, and a plurality of radially extending members disposed on an exterior of said cylindrical connector member and exposed to an ambient for transferring ambient heat to fluid present in said plurality of axial bores to vaporize said fluid in said plurality of axial bores;

a body coupled to said cylindrical member and having a centrally located axial bore extending therethrough, wherein said centrally located axial bore is in fluid communication with said plurality of axial bores within said cylindrical connector member;

said body further comprising at least two radial apertures that allow visual access to said centrally located axial bore; and a hose connector assembled to said body and in fluid communication with said centrally located axial bore;

wherein, when said vaporizer in use is connected to said liquid source, said plurality of axial bores contains the vaporized liquid.

10. The vaporizer of claim 9, further comprising an inlet nipple to which said hose nut mates, said inlet nipple being in fluid communication with said cylindrical connector member.

11. The vaporizer of claim 10, further comprising a cap, said cap being interposed between said inlet nipple and said cylindrical connector member.

* * * * *